US007299640B2

(12) United States Patent
Beck

(10) Patent No.: US 7,299,640 B2
(45) Date of Patent: Nov. 27, 2007

(54) REFRIGERATION SYSTEM WHICH COMPENSATES FOR HEAT LEAKAGE

(76) Inventor: Douglas S. Beck, 3319 21st Ave. NW., Gig Harbor, WA (US) 98335

( * ) Notice: Subject to any disclaimer, the term of this patent is extended or adjusted under 35 U.S.C. 154(b) by 264 days.

(21) Appl. No.: 10/964,796

(22) Filed: Oct. 13, 2004

(65) Prior Publication Data

US 2006/0075769 A1 Apr. 13, 2006

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 3,421,331 A * 1/1969 Webb ..... 62/6
4,827,736 A * 5/1989 Miura et al. ..... 62/51.1
5,012,650 A * 5/1991 Longsworth ..... 62/51.2
5,144,805 A * 9/1992 Nagao et al. ..... 62/6
5,152,147 A * 10/1992 Saho et al. ..... 62/6
5,317,878 A * 6/1994 Bradshaw et al. ..... 62/6
5,412,952 A * 5/1995 Ohtani et al. ..... 62/6
5,513,498 A * 5/1996 Ackermann et al. ..... 62/51.1
5,647,218 A * 7/1997 Kuriyama et al. ..... 62/6
5,918,470 A * 7/1999 Xu et al. ..... 62/51.1
7,114,341 B2 * 10/2006 Gao ..... 62/6
2004/0221586 A1 * 11/2004 Daniels ..... 62/6

* cited by examiner

*Primary Examiner*—William C Doerrler
(74) *Attorney, Agent, or Firm*—Clark A. Puntigam; Jensen & Puntigam, P.S.

(57) ABSTRACT

A refrigeration system/cycle includes two or more refrigeration stages, in which one or more of the warmer stages provide(s) cooling to partially compensate for heat leakage that would otherwise leak to the colder stage(s). The refrigeration system includes a single heat sink or multiple heat sinks. The refrigeration cycle can include a single cooling load or multiple cooling loads. The refrigeration system can be a cryogenic refrigeration cycle. The flow of working fluid can be DC (direct-current, continuous and uni-directional) or AC (alternating-current and oscillating). The refrigeration system can include Double-Cycle cooling action. The refrigeration system can include one (or more) thermal storage unit(s) (TSUs).

24 Claims, 1 Drawing Sheet

REFRIGERATION SYSTEM WHICH COMPENSATES FOR HEAT LEAKAGE

This invention was made with Government support under Grant No. F29601-02-C-0159, awarded by the Missile Defense Agency. The Government has certain rights in the invention.

TECHNICAL FIELD

This invention relates generally to refrigeration systems, and more particularly concerns a multi-stage refrigeration system which compensates for heat leakage.

BACKGROUND OF THE INVENTION

Refrigerators use input power to lift heat from a cold cooling load and reject heat to a warm heat sink. Refrigerators are hardware implementations of refrigeration cycles. Many different kinds of refrigeration cycles are used, depending on the application. For example, cryogenic refrigerators are refrigerators that provide cooling at cryogenic temperatures (which are typically defined as temperatures less than approximately 150 K), and cryogenic refrigerators typically use gas (often helium that remains single-phase) as the working fluid. Most space-based, long-life cryogenic refrigerators can be grouped into one of two categories, according to how the working fluid flows through the refrigerator: (1) DC-flow (direct-current, continuous, unidirectional flow) and (2) AC-flow (alternating-current, oscillating flow). DC-flow refrigerators include: Joule-Thomson coolers and Reverse-Brayton coolers. AC-flow refrigerators include Stirling coolers, Pulse-Tube coolers and Double-Cycle coolers. Double-Cycle coolers have two AC-flow sub-cycles (for example, Stirling or Pulse-Tube sub-cycles) that operate 180° out-of-phase (exactly out-of-phase). AC-flow refrigerators typically use regenerative heat exchangers ("regenerators"). As sub-cycles of Double-Cycle coolers, the regenerators of each of the sub-cycles are replaced by a recuperator, which transfers heat back and forth between the two sub-cycles.

The amount of cooling a refrigerators can achieve for a given amount of input power is limited by the Second Law of Thermodynamics. The maximum amount of cooling per unit of input power is the Carnot Coefficient of Performance (Carnot COP):

$$COP_{CARNOT} = \frac{Q_{CX}}{W_I} = \frac{T_C}{T_H - T_C} \tag{1}$$

where:

$COP_{CARNOT}$=Carnot Coefficient of Performance, (no units);

$Q_{cx}$=Maximum Amount of Cooling, Watts;

$W_I$=Input Power, Watts;

$T_C$=Temperature of the Cooling Load, K; and $T_H$=Temperature of the Heat Sink, K.

The actual COP achieved by a refrigerator must always be less than the Carnot COP, according to the Second Law of Thermodynamics. The efficiency of a refrigerator is often expressed in terms of the percentage of the Carnot COP achieved by the refrigerator.

It is important for space-based cryogenic refrigerators to have high efficiencies. For example, space-based cryogenic refrigerators typically have efficiencies in the range of 1% to 10%, depending on the temperature of the cooling load. Highly efficient refrigerators require little power input and reject little heat. The power input to a space-based cryogenic refrigerator typically comes from solar panels, and waste heat is typically rejected by radiators. Large power inputs require large and heavy solar panels, and large heat rejection requires large and heavy radiators. The solar panels and radiators must be launched into orbit, and launch costs are typically $10,000 per lb. Therefore, high efficiencies for space-based cryogenic refrigerators minimize launch costs.

A large source of inefficiency in cryogenic refrigerators is heat leakage from the warm parts of the refrigerators to the cold parts. The heat leakage typically is comprised of two main components: (1) heat flow due to heat exchanger ineffectivenesses and (2) heat conduction through the materials from which the parts are made. In addition to the refrigerator's cooling load (for example, cryogenically cooled infrared detectors), the heat leakage represents an additional cooling load that the refrigerator must cool. For example, if a cryogenic refrigerator could lift 2 W of heat at an efficiency of 10% if there were no heat leakage, and if 1 W of heat leakage is actually present, then the refrigerator can accommodate only 1 W of heat from an external cooling load, and its efficiency is actually only 5%.

Heat leakage is especially troublesome for cryogenic refrigerators that provide cooling at very cold temperatures (for example, 10 K with a heat-sink temperature of 300 K). Both components of heat leakage are proportional to temperature difference, so the large temperature difference between cold load temperatures and warm heat-sink temperatures causes large heat leakage. Also, it is very difficult thermodynamically to produce very cold cryogenic temperatures. This fact is evident by studying equation 1: for a given heat-sink temperature, the Carnot COPs of refrigerators with cold load temperatures are low. Cryocoolers with cold load temperatures produce little cooling and require large power inputs, and the cryocoolers have large flows of working fluid and large components. Therefore, large amounts of heat are carried to the cold components by the large flows of working fluid (due to heat exchanger ineffectivenesses) and conduction is large through the large components with large cross-sectional areas. The large heat leakage subtracts from the small amount of cooling to produce little net cooling and low efficiencies.

A solution that mitigates the effects of heat leakage is to interrupt the flow of heat from the warm end to the cold end at warm temperatures and provide refrigeration at the warm temperatures to partially compensate for the heat leakage. As equation 1 indicates, the Carnot COPs of refrigerators that cool at warm temperatures are higher than the Carnot COP of refrigerators that cool at colder temperatures. Therefore, it is possible to provide refrigeration at warm temperatures to partially compensate for the heat leakage with smaller amounts of power input than if the heat is allowed to leak to components at colder temperatures.

A refrigerator that provides cooling at multiple temperatures is called a multi-stage refrigerator (or cooler). In some multi-state refrigerators, some of the working fluid is diverted (from the main flow to the colder stage, or stages) to warm stages, where the working fluid is expanded to provide refrigeration. Multi-stage refrigerators exist, but none (to the author's knowledge) have been built in which the sole purpose of the warm refrigeration stages is to partially compensate for heat leakage to the cold components of the refrigerator.

A thermal storage unit (TSU) is an adjunct device that allows a refrigerator to achieve a transient operational load profile that would be unachievable otherwise. For example, typical space missions require relatively large amounts of cooling for short time intervals (for example, for 9 minutes), but only modest amounts of cooling for the rest of the cycle (for example, for 81 minutes). The average cooling (in Watts) is the heat lifted (in Joules) divided by the cycle period (in seconds). The average cooling for a typical space mission is relatively small, but the relatively large peak cooling requirement must be met to satisfy mission requirements. A way to meet the average cooling with a low-capacity cooler and meet the peak cooling requirement is to use a thermal storage unit (TSU). A TSU discharges (provides cooling) during short time intervals when the cooling requirement is relatively large, and the low-capacity cooler charges the TSU (removes heat from the TSU) during the rest of the cycle when the cooling requirement is relatively small.

Therefore, a need exists for a multi-stage refrigeration cycle whose intermediate stage(s) interrupt heat leakage from the warm end to the cold end of the cycle and provide(s) refrigeration to partially compensate for the heat leakage.

SUMMARY OF THE INVENTION

The invention is a refrigeration system that includes two or more refrigeration stages, in which one (or more) of the warmer stages provide(s) cooling to partially compensate for heat leakage that would otherwise leak to the colder stage(s). Particular aspects or embodiments of the refrigeration system include:

Single Heat Sink—In one embodiment of the invention, the refrigeration cycle includes a single heat sink. For example, space-based cryogenic refrigerators typically have available only a single heat sink that has an approximately constant temperature of approximately 300 K. The heat sink is typically a plate that transfers heat to a radiator, which in turn radiates heat to deep space. The heat-rejection heat exchanger of the refrigerator is bolted to the heat-sink plate.

Multiple Heat Sinks—In one embodiment of the invention, the refrigeration cycle includes multiple heat sinks. For example, the invention can be used together with one (or more) helper coolers to provide refrigeration at a cold temperature. The helper coolers would operate practically independently of the invention refrigerator (for example, their working fluids would be self-contained). The helper cooler(s) would provide refrigeration at warm stage(s) of the invention refrigerator, where the invention refrigerator would reject heat.

Single Cooling-Load Temperature—In one embodiment of the invention, the refrigeration cycle includes a single cooling-load temperature. For example, the simplest implementation of a cryogenic cooling system for a space-based infrared camera would lift all heat at the cryogenic operating temperature of the focal plane array (FPA) of the camera, so the cryogenic cooling system would have a single cooling-load temperature. For this example, the invention refrigeration cycle includes one (or more) intermediate refrigeration stage(s) at intermediate temperatures between the temperature(s) of the heat sink(s) and the single cooling-load temperature. The intermediate refrigeration stages interrupt heat leakage from the warm components to the cold components and provide refrigeration to partially compensate for the heat leakage.

Multiple Cooling-Load Temperatures—In one embodiment of the invention, the refrigeration cycle includes multiple cooling-load temperatures. For example, an implementation of a cryogenic cooling system for a space-based infrared camera would have a cooling load of approximately 10 W at 85 K and a second cooling load of approximately 1 W at 35 K. The 10 W at 85 K cooling load would be a cooling load from structures that insulate the FPA. The 1 W cooling load at 35 K would be a cooling load from the FPA itself. For this example, the invention refrigeration cycle includes intermediate refrigeration stages at intermediate temperatures between the temperatures of the heat sink(s) and the multiple cooling-load temperatures. The intermediate refrigeration stages interrupt heat leakage from the warm components to the cold components and provide refrigeration to partially compensate for the heat leakage.

Cryogenic Temperatures—In one embodiment of the invention, the refrigeration cycle is a cryogenic refrigeration cycle. For example, space-based infrared sensors must operate at cryogenic temperatures. For this example, the invention refrigeration cycle includes intermediate refrigeration stage(s) at intermediate temperature(s) between the temperatures of the heat sink(s) and the cryogenic cooling load(s). The intermediate refrigeration stages interrupt heat leakage from the warm components to the cold components and provide refrigeration to partially compensate for the heat leakage.

DC-Flow—In one embodiment of the invention, the flow of working fluid in the refrigeration cycle is a DC-flow (direct-current, continuous, and unidirectional). For example, with a Reverse-Brayton cooler, some of the main flow to the cold components is diverted at warm-temperature stages to expanders (for example, turbo-expanders), which absorb power from the diverted flow to provide refrigeration. The refrigeration partially compensates for heat leakage.

AC-Flow—In one embodiment of the invention, the flow of working fluid in the refrigeration cycle is an AC-flow (alternating-current, oscillating flow). For example, with a Stirling cooler, some of the main flow to the cold components is diverted to (and collected from) one (or more) warm-temperature stage(s) to (and from) one (or more) expander(s) (for example, piston(s)), which absorb power from the flow to provide refrigeration. The refrigeration partially compensates for heat leakage.

Double Cycles—In one embodiment of the invention, the refrigeration cycle is a double cycle. Double cycle refrigeration cycles have been described in, for example, an article by Daney, D. E., "*Refrigeration for Cryogenic Sensors and Electronic Systems*", NBS SP 607 (1981) p. 48, as well as other articles. For example, with a Double-Stirling cooler, some of the main flow in each of the sub-cycles is diverted to (and collected from) warm-temperature stages to (and from) expanders, which absorb power from the flows to provide refrigeration. The refrigeration partially compensates for heat leakage.

Thermal Storage Units (TSUs)—In one embodiment of the invention, the refrigeration cycle uses a thermal storage unit (TSU) to achieve a transient load profile that would be unachievable otherwise.

BEST MODE FOR CARRYING OUT THE INVENTION

Figure 1:
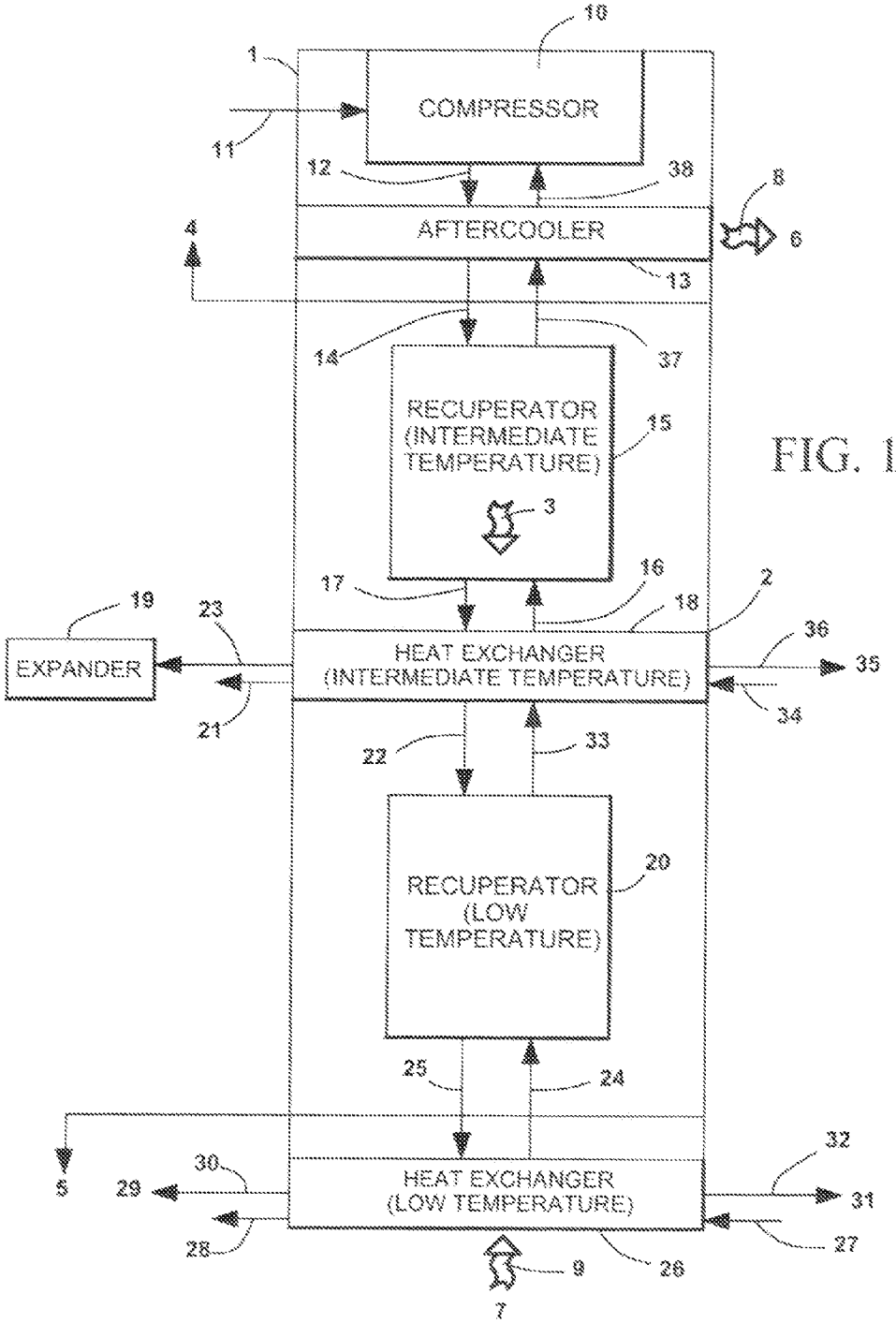
FIG. 1 shows one embodiment of the invention, a multi-stage cryogenic Double-Stirling refrigeration cycle with an intermediate stage that interrupts heat leakage from the warm end to the cold end and provides refrigeration to partially compensate for the heat leakage.

FIG. 1 shows one embodiment of the invention, a multi-stage cryogenic Double-Stirling refrigeration cycle 1, with an intermediate stage 2 that interrupts heat leakage 3 from the warm end 4 to the cold end 5 and provides refrigeration 23, 36 to partially compensate for the heat leakage 3; that rejects heat 8 to a single heat sink 6; and that absorbs heat 9 from a single cooling load 7. Partial compensation is provided, for instance, by cooling the gas from an intermediate recuperator and/or the components of that portion of the refrigerator. In the following, the flow of the working fluid will be traced through the system to show how the cycle 1 provides cryogenic refrigeration 9 for the cooling load 7.

The flows of working fluid in the sub-cycles of a Double-Stirling refrigeration cycle are AC and out-of-phase. At the instant shown in FIG. 1, the working fluid in the sub-cycle on the left-hand side of FIG. 1 is flowing from the warm end 4 of the refrigeration cycle 1 to the cold end 5, and the working fluid in the sub-cycle on the right-hand side of FIG. 1 is flowing from the cold end 5 of the refrigeration cycle 1 to the warm end 4. In the following, the flow of working fluid in the sub-cycle on the left-hand side of FIG. 1 will be considered first. Then, the flow of working fluid in the sub-cycle on the right-hand side of FIG. 1 will be considered.

The compressor 10 converts a mechanical power input 11 applied to the working fluid in each sub-cycle of the Double-Stirling refrigeration cycle. The mechanical power input raises the pressure of the working fluid in each sub-cycle. For example, for a space-based, long-life cryogenic refrigerator, a double-compressor with two compression chambers could be used as the compressor 10 to raise the pressure of the working fluid from a low pressure of 50 psia up to a high pressure of 150 psia. The double-compressor could use voice-coil linear actuators to convert an electrical power input 11 from power electronics into linear forces that drive the pistons of the double compressor. The linear forces would provide the mechanical power input to the working fluid in each sub-cycle.

Warm high-pressure gas 12 from the compressor 10 flows to an aftercooler 13. The aftercooler 13 removes heat 8 from the gas and transfers the heat 8 to the heat sink 6.

The resulting cooled high-pressure gas 14 flows through an intermediate-temperature (IT) recuperator 15. As the cooled high-pressure gas 14 flows through the IT recuperator 15, the gas 14 is cooled by cool low-pressure gas 16 that enters the other side of the IT recuperator 15, in the other sub-cycle, and flows through the IT recuperator 15 in the opposite direction. Cool high-pressure gas 17 exits from the IT recuperator 15 with a temperature that is significantly colder than the temperature of the heat sink 6. It is typically thermodynamically optimal for the intermediate temperature to be the geometric mean temperature between the temperature of the cooling load 7 and the temperature of the heat sink 6.

Therefore, for a refrigeration cycle 1 that provides cooling at 4 K, with a 300 K temperature of the heat sink 6, the optimal intermediate temperature would be 35 K. For a refrigeration cycle 1 that provides cooling at 100 K, with a 300 K temperature of the heat sink 6, the optimal intermediate temperature would be 173 K. Therefore, intermediate temperatures typically are in the range of 30 K to 200 K for cryogenic refrigerators. For example, in a space-based cryogenic refrigerator, the temperature of the heat sink 6 could be 300 K, and the cool high-pressure gas 17 might exit the IT recuperator 15 at approximately 57.5 K.

The cool high-pressure gas 17 from the IT recuperator 15 flows to an IT load heat exchanger 18. In the IT load heat exchanger 18, the gas splits into two paths: (1) some of the gas flows to an IT expander 19; and (2) some of the gas flows to a low-temperature (LT) recuperator 20. As both high-pressure sub-flows pass through the IT load heat exchanger 18, the sub-flows are cooled by low-pressure flows in the other sub-cycle that flow in opposite directions through the other side of the IT load heat exchanger 18. For example, in a space-based cryogenic refrigerator, the high-pressure sub-flows might be cooled by the IT load heat exchanger 18 from inlet temperatures of 57.5 K to outlet temperatures of 54.8 K. One cooled high-pressure sub-flow 21 exits the IT load heat exchanger 18 and flows to an IT expander 19. The second cooled high-pressure sub-flow 22 exits the IT load heat exchanger 18 and flows to the LT recuperator 20.

An IT expander 19 removes mechanical power 23 from one of the high-pressure sub-flows 21, so the pressure and temperature of the sub-flow are reduced. In a cryogenic refrigerator, the pressure of the sub-flow could be reduced from approximately 150 psia to approximately 50 psia, and the temperature could be reduced from approximately 54.8 K to approximately 40 K. An example of a hardware implementation of an IT expander 19 is a piston whose position is controlled by a linear motor as the piston reciprocates in a cylinder and displaces volume in a chamber defined by the piston and the cylinder. The linear motor absorbs the mechanical power 23 from the piston, and the linear motor could convert the mechanical power 23 into electrical power. For example, a voice-coil linear actuator is one type of linear motor that could be used.

The second sub-flow 22 flows through the LT recuperator 20. As the cool high-pressure gas 22 flows through the LT recuperator 20, the gas 22 is cooled by cool low-pressure gas 24 that enters the other side of the LT recuperator 20, in the other sub-cycle, and flows through the LT recuperator 20 in the opposite direction. Cold high-pressure gas 25 exits the LT recuperator 20 with a temperature that is significantly colder than the temperature of the entering gas 22. For example, in a space-based cryogenic refrigerator, the cold high-pressure gas 25 could exit the LT recuperator 20 at approximately 10.5 K.

The cold high-pressure gas 25 that exits the LT recuperator 20 flows through an LT load heat exchanger 26. As the gas 25 flows through the LT load heat exchanger 26, the gas 25 is cooled by cold low-pressure gas 27 that enters the other side of the LT load heat exchanger 26. The high-pressure gas 28 exits the LT load heat exchanger 26 at a colder temperature than the gas 25 that enters the LT load heat exchanger 26. For example, in a space-based cryogenic refrigerator, the cold high-pressure gas 28 could exit the LT load heat exchanger 26 at approximately 10 K.

From the LT load heat exchanger 26, the cold gas 28 flows to an LT expander 29. The LT expander 29 removes mechanical power 30 from the gas 28, so the pressure and temperature of the gas 28 are reduced. An example of a hardware implementation of an LT expander 29 is a piston whose position is controlled by a linear motor as the piston reciprocates in a cylinder and displaces volume in a chamber defined by the piston and the cylinder. The linear motor absorbs the mechanical power 30 from the piston, and the linear motor could convert the mechanical power 30 into electrical power.

Now the flow of working fluid in the sub-cycle on the right-hand side of FIG. 1 will be considered. An LT expander 31 removes mechanical power 32 from the working fluid, and the resulting low-pressure cold gas 27 flows to the LT load heat exchanger 26. The cold gas 27 flows through the LT load heat exchanger 26, where it absorbs heat from two sources: (1) the flow of working fluid in the other sub-cycle; and (2) the heat flow 9 from the cooling load 7. The resulting heated low-pressure gas 24 exits the LT load heat exchanger 26.

The heated low-pressure gas 24 then flows through the LT recuperator 20. In the LT recuperator 20, the low-pressure gas absorbs heat from the working fluid in the other sub-cycle, and the low-pressure gas 33 exits the LT recuperator 20 at a warmer temperature than the temperature of the entering gas 24.

The low-pressure gas 33 then flows to the IT load heat exchanger 18. In the IT load heat exchanger 18, two flows combine to form one outlet flow 16: (1) one flow is gas 33 from the LT recuperator 20; and (2) the other is flow 34 from an IT expander 35. The IT expander 35 removes mechanical power 36 from the working fluid, and the resulting low-pressure cold gas 34 flows to the IT load heat exchanger 18. In the IT load heat exchanger 18, the two low-pressure flows 33, 34 absorb heat from the high-pressure flows 21, 22 in the other sub-cycle. The combined low-pressure flow 16 exits the IT load heat exchanger 18 and flows to the IT recuperator 15.

As the low-pressure flow passes through the IT recuperator 15, the low-pressure flow absorbs heat from the high-pressure flow in the other sub-cycle on the other side of the IT recuperator 15. The resulting heated low-pressure gas flow 37 flows to the aftercooler 13.

The low-pressure gas 37 flows through the aftercooler 13, where the low-pressure gas 37 absorbs some heat from the high-pressure gas flow 12 in the other sub-cycle on the other side of the aftercooler 13. The low-pressure gas flow 38 exits the aftercooler 13 and flows to the compressor 10. In the compressor 10, the low-pressure gas begins another cycle.

As discussed in detail above, the present embodiment of a refrigeration system includes a plurality of refrigeration stages, in which at least one of the warmer stages provides cooling to a selected portion of the refrigeration system, such as the gas 17 from recuperator 15 and the physical components of that stage, in order to compensate for heat leakage to the colder stages and heat conduction through various refrigerator components.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A refrigeration system, comprising:

two or more refrigeration stages, at least one of which is a warmer stage than the remaining stages, which are colder;

wherein at least one of the warmer stages includes a refrigeration member, wherein gas flowing from the refrigeration member is divided into two sub-flows and cooled, one sub-flow being directed to a follow-on refrigeration stage for further cooling and the other sub-floor being diverted to an expander which absorbs mechanical power therefrom, reducing the temperature of the other sub-flow, the other sub-flow compensating for thermal leakage within the refrigeration member and components thereof in the at least one warmer stage that would otherwise leak to the colder stage(s), wherein the temperature of the one sub-flow at the division of the two sub-flows is approximately the geometric mean temperature between the temperature of cooling load component(s) at a colder stage and the temperature of heat accepting component(s) to which heat is rejected at the warmer stage.

2. The refrigeration system of claim 1, further including at least one heat sink to which heat from the refrigeration system is rejected.

3. The refrigeration system of claim 1, further including a plurality of heat sinks to which heat from the refrigeration system is rejected.

4. The refrigeration system of claim 1, further including at least one cooling load from which the refrigeration system absorbs heat.

5. The refrigeration system of claim 1, further including a plurality of cooling loads from which the refrigeration system absorbs heat.

6. The refrigeration system of claim 1, which includes a cryogenic refrigeration cycle.

7. The refrigeration system of claim 1, having a flow of working fluid which is direct-current, continuous and unidirectional.

8. The refrigeration system of claim 1, having a flow of working fluid which is alternating-current and oscillating.

9. The refrigeration system of claim 8, further including a Double-Cycle cooling action.

10. The refrigeration system of claim 4, further including a thermal storage unit (TSU) in thermal contact with one or more of the cooling loads.

11. The refrigeration system of claim 9, further including a thermal storage unit (TSU) in thermal contact with one or more cooling loads from which the refrigeration system absorbs heat.

12. The refrigeration system of claim 1, wherein the temperature of the one sub-flow is approximately the geometric mean temperature between the temperature of the cooling load component(s) and the temperature of a heat sink at the warmer stage.

13. The refrigeration system of claim 9, wherein the refrigeration system is a Double-Stirling refrigeration cycle, wherein the refrigeration member is a recuperator and wherein high pressure gas flowing into the recuperator in one sub-cycle is at approximately the same temperature as low pressure gas from the recuperator in the other sub-cycle and wherein high pressure gas from the heat exchanger in the one sub-cycle is at approximately the same temperature as low pressure gas into the heat exchanger in the other sub-cycle.

14. A refrigeration system, comprising:

two or more refrigeration stages, at least one of which is a warmer stage than the remaining stages, which are colder;

wherein at least one of the warmer stages includes a refrigeration member, wherein gas flowing from the refrigeration member is divided into two sub-flows and cooled, one sub-flow being directed to a follow-on refrigeration stage for further cooling and the other sub-flow being diverted to an expander which absorbs mechanical power therefrom, reducing the temperature of the other sub-flow, the other sub-flow compensating for thermal leakage within the refrigeration member and components thereof in the at least one warmer stage that would otherwise leak to the colder stages, wherein the gas from the refrigeration member is divided into two sub-flows and cooled in a heat exchanger prior to one sub-flow being directed to the follow-on refrigeration member and the other sub-flow being diverted to the expander.

15. The refrigeration system of claim 14, further including at least one heat sink to which heat from the refrigeration system is rejected.

16. The refrigeration system of claim 14, further including a plurality of heat sinks to which heat from the refrigeration system is rejected.

17. The refrigeration system of claim 14, further including at least one cooling load from which the refrigeration system absorbs heat.

18. The refrigeration system of claim 14, further including a plurality of cooling loads from which the refrigeration system absorbs heat.

19. The refrigeration system of claim 14, which includes a cryogenic refrigeration cycle.

20. The refrigeration system of claim 14, having a flow of working fluid which is direct-current, continuous and uni-directional.

21. The refrigeration system of claim 14, having a flow of working fluid which is alternating-current and oscillating.

22. The refrigeration system of claim 21, further including a Double-Cycle cooling action.

23. The refrigeration system of claim 17, further including a thermal storage unit (TSU) in thermal contact with one or more of the cooling loads.

24. The refrigeration system of claim 22, further including a thermal storage unit (TSU) in thermal contact with one or more cooling loads from which the refrigeration system absorbs heat.

* * * * *

UNITED STATES PATENT AND TRADEMARK OFFICE

CERTIFICATE OF CORRECTION

PATENT NO. : 7,299,640 B2
APPLICATION NO. : 10/964796
DATED : November 27, 2007
INVENTOR(S) : Douglas S. Beck It is certified that error appears in the above-identified patent and that said Letters Patent is hereby corrected as shown below:

Col. 7, Claim 1, line 10, the word "sub-floor" should be --sub-flow--.

Signed and Sealed this

Fifteenth Day of April, 2008

JON W. DUDAS
*Director of the United States Patent and Trademark Office*